US006883911B2

(12) United States Patent
Niimi et al.

(10) Patent No.: US 6,883,911 B2
(45) Date of Patent: Apr. 26, 2005

(54) FABRIC PRINTING DEVICE

(75) Inventors: Akiko Niimi, Nagoya (JP); Katsuya Watarai, Mizunami (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/793,865

(22) Filed: Mar. 8, 2004

(65) Prior Publication Data

US 2004/0189776 A1 Sep. 30, 2004

(30) Foreign Application Priority Data

Mar. 27, 2003 (JP) ..... 2003-087545

(51) Int. Cl.[7] ..... B41F 1/38

(52) U.S. Cl. ..... 347/104; 347/4; 101/126; 101/474

(58) Field of Search ..... 347/4, 104; 101/126, 101/474

(56) References Cited

U.S. PATENT DOCUMENTS 5,188,034 A * 2/1993 Iaccino et al. ..... 101/474
5,345,863 A 9/1994 Kurata et al.
5,372,506 A * 12/1994 Hambright ..... 434/84
6,042,228 A * 3/2000 Yamada et al. ..... 347/104
6,095,628 A 8/2000 Rhome
6,640,714 B1 * 11/2003 Papa ..... 101/474

FOREIGN PATENT DOCUMENTS

| | | | |
|---|---|---|---|
| JP | 55137968 A * | 10/1980 | ..... B41F/15/16 |
| JP | A 6-220781 | 8/1994 | |
| JP | A 7-164697 | 6/1995 | |
| JP | A 8-169147 | 7/1996 | |
| JP | A 11-13744 | 1/1999 | |
| JP | A 11-227171 | 8/1999 | |
| JP | A 2000-198970 | 7/2000 | |
| JP | A 2002-249976 | 9/2002 | |

* cited by examiner

*Primary Examiner*—Andrew H. Hirshfeld
*Assistant Examiner*—Jill E. Culler
(74) *Attorney, Agent, or Firm*—Oliff & Berridge, PLC

(57) ABSTRACT

A fabric printing device contains a supporting section on which a fabric can be installed and removed, having a supporting face for supporting an installed fabric from below; and an ink emitting section for emitting ink onto the fabric on said supporting face. The supporting section has a section in which the coefficient of static friction acting on the fabric in the central region of said supporting face is greater than the coefficient of static friction acting on the fabric in regions in the vicinity of the respective end sections of said supporting face in at least one direction thereof.

7 Claims, 5 Drawing Sheets

FABRIC PRINTING DEVICE

BACKGROUND OF THE INVENTION

1. Field of the Invention

The present invention relates to a fabric printing device for printing a desired image onto a fabric installed on the supporting face of a supporting section, by emitting ink.

2. Description of the Related Art

In a fabric printing device of this kind, unlike printing onto paper, or the like, it is difficult to fix a fabric onto the upper face of the platen or other supporting section on which the fabric is installed. In other words, in the case of fabric, creases caused by wrinkles in the surface are liable to occur, and the flatness of the fabric is liable to be impaired. If the fabric cannot be held flat on the platen, then the accuracy of printing by emitting ink will decline, and depending on the circumstances, situations may occur in which the ink emission heads actually make contact with the fabric.

Japanese Patent Application Laid-open No. 2000-198970, for example, discloses an ink-jet fabric printing device wherein, in order to hold fabric for fabric printing, a double-sided tape or sheet having adhesive characteristics is attached to an endless metallic belt, and the fabric is fixed on the belt by the adhesive force thereof and conveyed. This adhesive double-sided tape or sheet is formed such that it has strong adhesive properties on the inner side (conveyor belt side) and weak adhesive properties on the outer side (fabric side), and one end thereof is stuck on the other end thereof to be formed into a ring-shape. The fabric is fixed to the conveyor belt via the adhesive sheet, by means of separately provided attachment rollers, and a configuration is achieved which ensures that the fabric is flat when printing is carried out. Moreover, if the adhesive force of the double-sided adhesive sheet declines, then it can be changed for another one.

Furthermore, Japanese Patent Application Laid-open No. (Hei)6-220781 discloses a method for an ink-jet printing device in which a double-sided adhesive sheet (adhesive film) is attached to an endless metallic belt, and fabric is adhered to this double-sided adhesive sheet and conveyed. If the adhesive force of the double-sided adhesive sheet declines, then the sheet is peeled off, and a new double-sided adhesive sheet is attached to the conveyor belt by being drawn out from an adjacently positioned roll.

However, in the device and method described in both Japanese Patent Application Laid-open Nos. 2000-198970 and (Hei)6-220781, an adhesive sheet is stuck onto a belt, and a fabric is conveyed by being fixed by the adhesive force of this sheet. Therefore, in a fabric printing device wherein fabric is installed on a platen, if a configuration is adopted whereby the fabric is installed on an adhesive sheet of this kind, the following problems will occur.

In other words, in a configuration for holding fabric by means of adhesive force, if creases occur due to wrinkles in the fabric, then it will be necessary to peel off the fabric from one end thereof, against the adhesive force, and reinstall the fabric carefully on the platen in such a manner that no wrinkles are formed. Therefore, a problem arises in that the tasks of installing the fabric and aligning it in position become very difficult indeed. Moreover, when eliminating wrinkles in the fabric, or when removing the fabric after printing, the fabric is peeled off against the adhesive force, and therefore a problem arises in that pilling of the fabric, and the like, is liable to occur.

Furthermore, if an adhesive sheet is provided on the surface of the platen, dust or threads from the fabric, or the like, are liable to attach themselves to the adhesive sheet, and hence it becomes necessary to clean the surface of the platen at frequent intervals, or to replace the adhesive sheet at frequent intervals. Therefore, problems arise in that costs increase, and maintainability declines.

SUMMARY OF THE INVENTION

Therefore, it is an object of the present invention to provide a fabric printing device providing excellent ease of use and good maintainability, whereby wrinkles in a fabric installed on a supporting face of a supporting section can be eliminated in a simple manner, thereby removing any creases in the fabric, and hence the fabric can be held reliably in a highly flat state.

The present invention provides a fabric printing device which comprises: a supporting section on which a fabric can be installed and removed, having a supporting face for supporting an installed fabric from below; and an ink emitting section for emitting ink onto the fabric on the supporting face; wherein the supporting section has a section in which the coefficient of static friction acting on the fabric in the central region of the supporting face is greater than the coefficient of static friction acting on the fabric in regions in the vicinity of the respective end sections of the supporting face in at least one direction thereof.

By adopting a configuration of this kind, when a fabric is installed on the supporting section, since there is a portion wherein a large static frictional force acts on the fabric in the central region of the supporting face, then the fabric is held in position by the frictional force. Since the fabric is held simply by means of a frictional force, unlike a case where a fabric is held by an adhesive force, then creases in the fabric can be eliminated readily, simply by smoothing the surface of the fabric lightly by hand and spreading out any wrinkles, and in this state, the fabric can be held reliably in a highly flat state by the frictional force.

Furthermore, since the static frictional force in at least the regions in the vicinity of the respective end sections of the supporting face is relatively small, then even if the fabric is larger than the supporting face, the frictional force has substantially no effect on the respective side portions of the fabric which contact the regions in the vicinity of the respective end sections of the supporting face. Thereby, when installing the fabric on the supporting section, aligning the position thereof, or removing it from same, by raising the fabric above the supporting face and causing only the respective side portions thereof to contact the respective end sections of the supporting face, it is possible to slide the side portions of the fabric over the platen smoothly. Therefore, the tasks of installing the fabric, aligning the position thereof and removing same can be performed readily.

Furthermore, since the fabric is held in place simply by a frictional force, rather than an adhesive force, then dust, or the like, is not liable to adhere to the supporting face, and hence it does not need to be cleaned regularly.

In the fabric printing device according to the present invention, it is preferable that, in the supporting section, the coefficient of static friction acting on the fabric in the region of the supporting face other than the regions in the vicinity of the respective end sections is greater than the coefficient of static friction acting on the fabric in the region of the supporting face in the vicinity of the respective end sections.

By adopting this configuration, when a fabric is installed on the supporting section, since a large static frictional force acts on the fabric in the region other than the regions in the vicinity of the respective end sections of the supporting face, then any wrinkles in the fabric in this region can be eliminated even more readily.

In the fabric printing device according to the present invention, it is preferable that, in the supporting section, the coefficient of static friction acting on the fabric in the region of the supporting face other than from the regions in the vicinity of the respective end sections is substantially uniform throughout the region.

By adopting this configuration, when a fabric is installed on the supporting section, since a large static frictional force acts uniformly on the fabric in the region other than the regions in the vicinity of the respective end sections of the supporting face, then any wrinkles in the fabric in this region can be eliminated even more readily and uniformly.

In the fabric printing device according to the present invention, it is preferable that, in the supporting section, a sheet-shaped member is adhered to or mounted on the region of the supporting face other than the regions in the vicinity of the respective end sections.

By adopting a configuration of this kind, since a large frictional force acts on the fabric by means of a sheet-shaped member on the supporting face, then creases in the fabric can be eliminated simply by spreading out the wrinkles in the fabric, as described above, and in this state, the fabric can be held reliably in a highly flat state by the frictional force. Moreover, if the sheet-shaped member becomes soiled, it can be replaced with a new one, and hence maintenance is also easy to perform. Furthermore, if a sheet-shaped member is used, then it can be changed in accordance with the type of material of the fabric installed on the device, and hence general applicability is good.

In the fabric printing device according to the present invention, the regions in the vicinity of the respective end sections are preferably regions extending from each end section to a position 1 mm–10 mm distant therefrom.

By adopting a configuration of this kind, by setting suitable regions in the vicinity of the respective end sections where the static frictional force acting on the fabric is small, a suitably large surface area for holding the fabric in the region other than these regions in the vicinity of the respective end sections can be ensured, and furthermore, it is possible to slide the respective side portions of the fabric smoothly in the regions in the vicinity of the respective end sections, as described previously.

In the fabric printing device according to the present invention, the upper portions of the respective end sections in at least one direction of the supporting face are preferably formed with arc surfaces.

By adopting a configuration of this kind, it is possible to cause the respective side portions of the fabric to slide even more smoothly over the arc faces of the respective end sections of the supporting face. Moreover, when a fabric is installed on the supporting face, the respective side portions of the fabric are prevented from catching and rising up, due to the presence of the arc faces on the respective end sections.

In the fabric printing device according to the present invention, the ink emitting section and the supporting section can preferably be moved relative to each other.

By adopting a configuration of this kind, after installing the fabric on the supporting section, the fabric can be moved to the position of the ink emission section, and hence the tasks of installing the fabric, aligning the position thereof and removing same become easy to perform.

BRIEF DESCRIPTION OF THE DRAWINGS

FIGS. 4A, 4B, 4C and 4D show enlarged cross-sectional views along B—B in FIG. 2 showing the principal part of the platen, wherein FIG. 4A shows a state in which the fabric is installed, aligned in position and removed; FIG. 4B shows a state where wrinkles in the fabric are eliminated; FIG. 4C shows a state where the fabric is held in a flat state; and FIG. 4D shows a comparative example, illustrating a state where no curved faces are provided on the end sections of the platen.

DESCRIPTION OF THE PREFERRED EMBODIMENTS

Below, a preferred embodiment of the present invention is described with respect to the drawings. The fabric printing device relating to the present embodiment is an ink-jet printer.

(General Configuration of the Printer)

Figure 1:
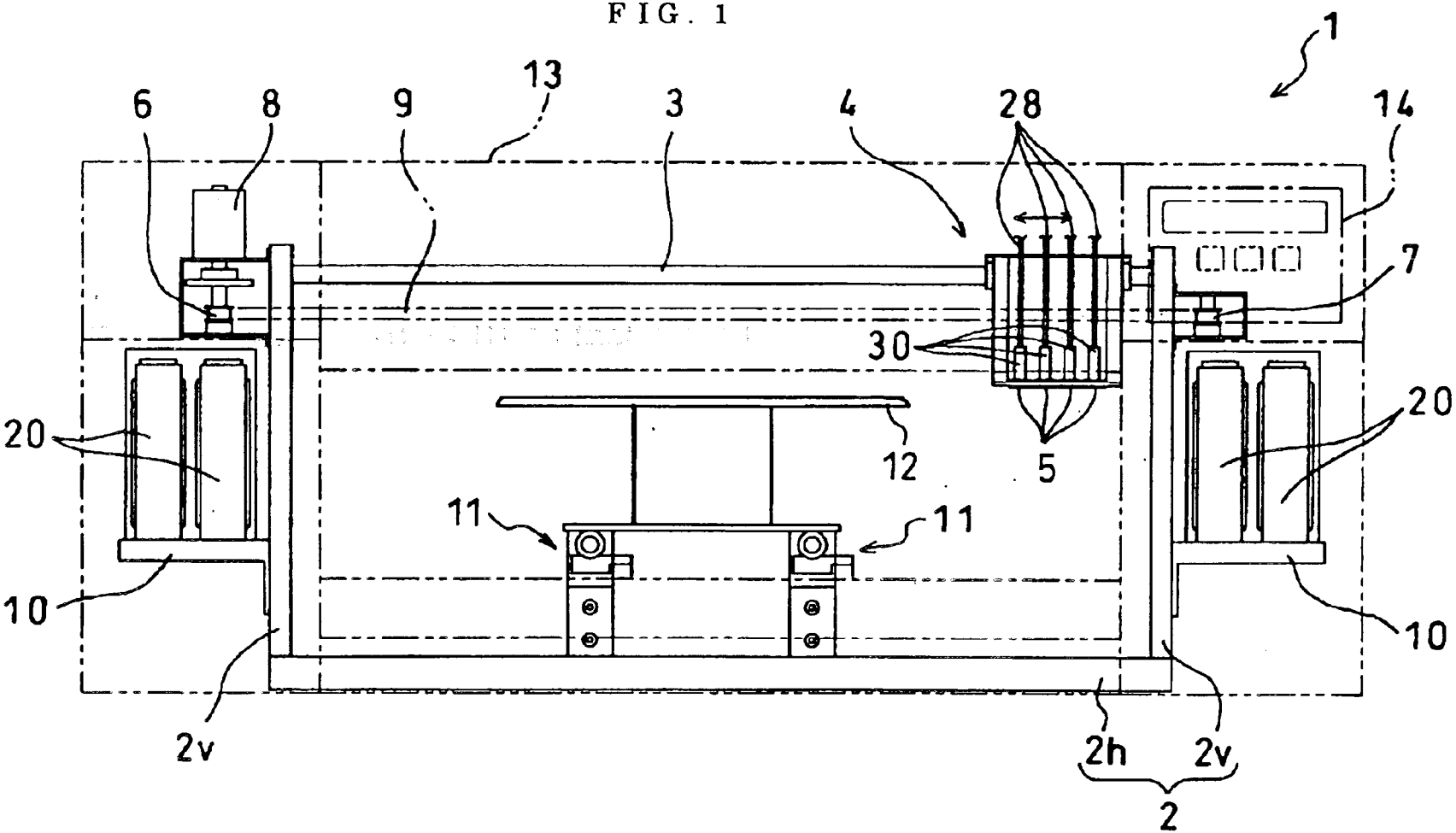
FIG. 1 is a front view showing the general configuration of an ink-jet printer relating to one embodiment of the present invention.

FIG. 1 is a front view showing the general configuration of an ink-jet printer relating to one embodiment of the present invention. As shown in FIG. 1, the ink-jet printer 1 comprises a frame 2. This frame 2 has a horizontal section 2*h* disposed in the lower part of the printer 1, and vertical sections 2*v* which rise up vertically from the respective ends of the horizontal section 2*h*.

A slide rail 3 is suspended horizontally in such a manner that the upper portions of the respective left and right-hand vertical sections 2*v* are mutually connected. A carriage 4 is provided on the slide rail 3, slidably in the longitudinal direction of the slide rail 3 (main scanning direction). A total of four piezoelectric ink-jet heads 5 are provided on the lower face of the carriage 4, one head being disposed for one of four colours (for example, cyan, magenta, yellow or black) in order to emit ink of that colour.

Pulleys 6, 7 are supported respectively on the left and right-hand vertical sections 2*v*, and a motor shaft of a motor 8 supported by the vertical sections 2*v* is coupled to one of the pulleys 6. An endless belt 9 is extended between the pulleys 6, 7, and the carriage 4 is fixed to an appropriate portion of this endless belt 9.

By means of the above configuration, when the pulley 6 is rotated in the forward or backward direction by the drive of the motor 8, the carriage 4 is accordingly driven reciprocatingly in a linear fashion, in the longitudinal direction of the slide rail 3 (main scanning direction), and consequently, the ink-jet heads 5 perform reciprocating movement, back and forth.

A mounting section 10 on which an ink tank 20 can be mounted detachably is formed respectively on both of the left and right-hand vertical sections 2*v*. The two mounting sections 10 are each capable of holding ink tanks 20 for two colours, and ink bags formed inside each ink tank 20 are connected respectively to four subsidiary tanks 30 provided respectively on the top ends of the ink-jet heads 5, by means of flexible tubes 28. The four subsidiary tanks 30 are respectively connected to the ink-jet heads 5, whereby ink can be supplied form the ink tanks 20 to the ink-jet heads 5.

A slide mechanism 11 is disposed on the horizontal section 2*h* of the frame 2, and a platen 12 is supported on this slide mechanism 11. Fabric can be positioned on this platen 12 in such a manner that the portion to be printed is facing upwards, the fabric being pulled tight in a flat and unwrinkled state thereon. The ink-jet printer 1 according to the present embodiment performs ink-jet printing onto a T-shirt that has been embroidered.

Moreover, a platen conveyance mechanism is provided in order that the platen 12 moves reciprocatingly in a direction perpendicular to the paper in FIG. 1 (a subsidiary scanning direction of the ink-jet printer 1 and the sliding direction of the sliding mechanism 11). This platen conveyance mechanism is not illustrated, but it may be constituted by means of a rack and pinion mechanism, or an endless belt mechanism, or the like.

In the initial state, the platen 12 moves in a forward direction (towards the reader in the case of FIG. 1), the operators sets the fabric on the platen 12, and when a printing start command is issued, the platen 12 is moved in the rearward direction (away from the reader in FIG. 1). By means of the platen 12 being moved intermittently in the forward direction, whilst the ink-jet head 5 is moved reciprocatingly between each intermittent movement of the platen, printing is carried out onto the fabric. When printing has been completed, the platen 12 moves back to its initial position on the front side. The operator then removes the fabric from the platen 12.

As shown in FIG. 1, the four ink-jet heads 5 are provided in a parallel fashion in the direction of reciprocating movement of the carriage 4, one head being provided for one of four ink colours (magenta, yellow, cyan or black), and they are connected to their corresponding ink tanks 20 by means of flexible tubes 28 and subsidiary tanks 30.

The ink-jet heads 5 are disposed in such a manner that the lower faces thereof form a small gap with respect to the upper face of the platen 12, and when printing an image onto a fabric, the region to be printed on the fabric set on the platen 12 passes through this gap. By means of this configuration, by moving the ink-jet heads 5 reciprocatingly by means of the carriage 4, whilst emitting ink of respective colours onto the fabric from the emission nozzles, it is possible to form a desired colour image onto the fabric.

Moreover, a cover 13 is provided on the ink-jet printer 1, in such a manner that it can cover and protect the ink-jet heads 5, the slide mechanism 11, and the like. In FIG. 1, the cover 13 is shown in a transparent fashion by means of a dotted line, in order that the detailed configuration inside the cover 13 can be depicted. An operating panel 14 provided with a liquid crystal display section and operating keys is disposed on the front face of the cover 13, in the upper right position in FIG. 1.

(Configuration of Platen)

Figure 2:
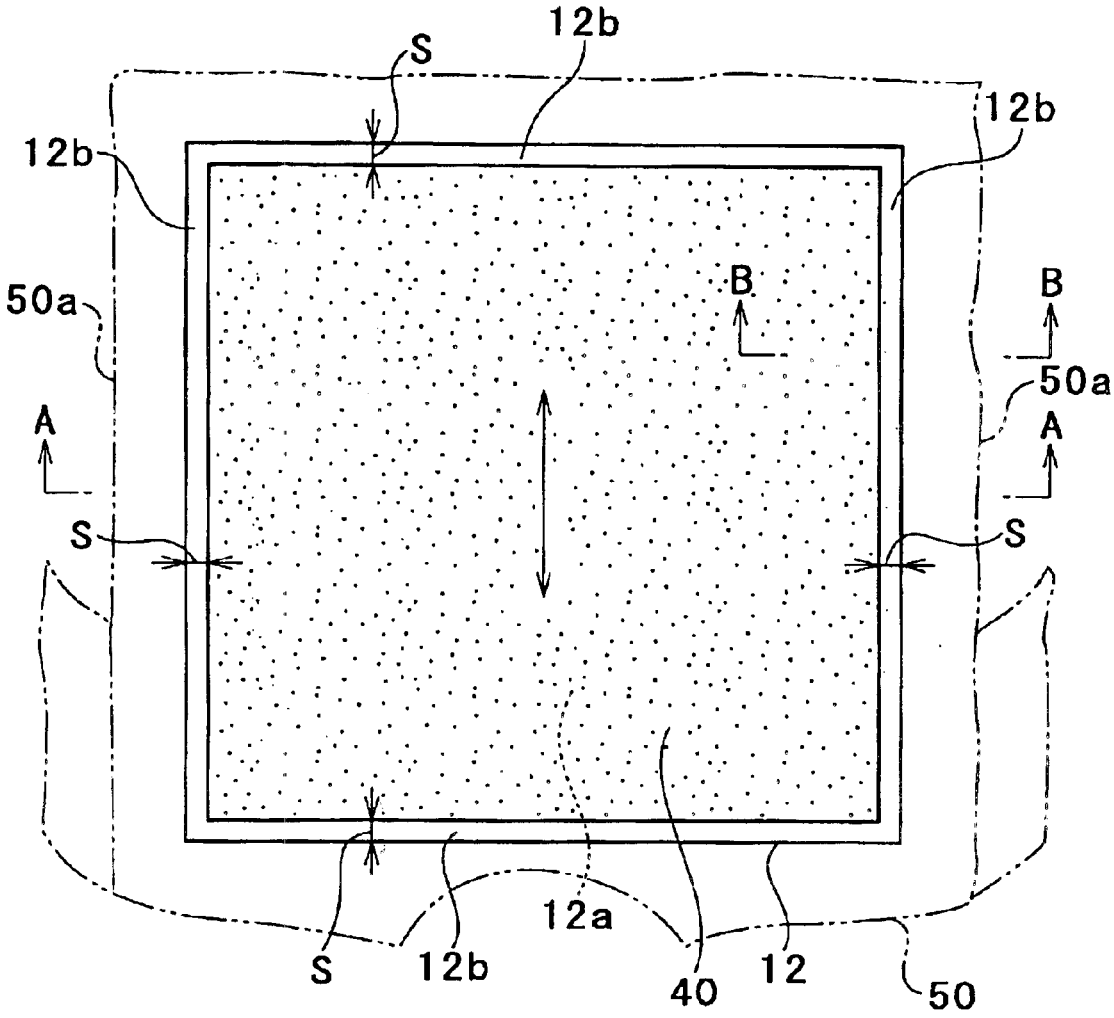
FIG. 2 is a plan view showing the configuration of the platen in FIG. 1.
Figure 3:
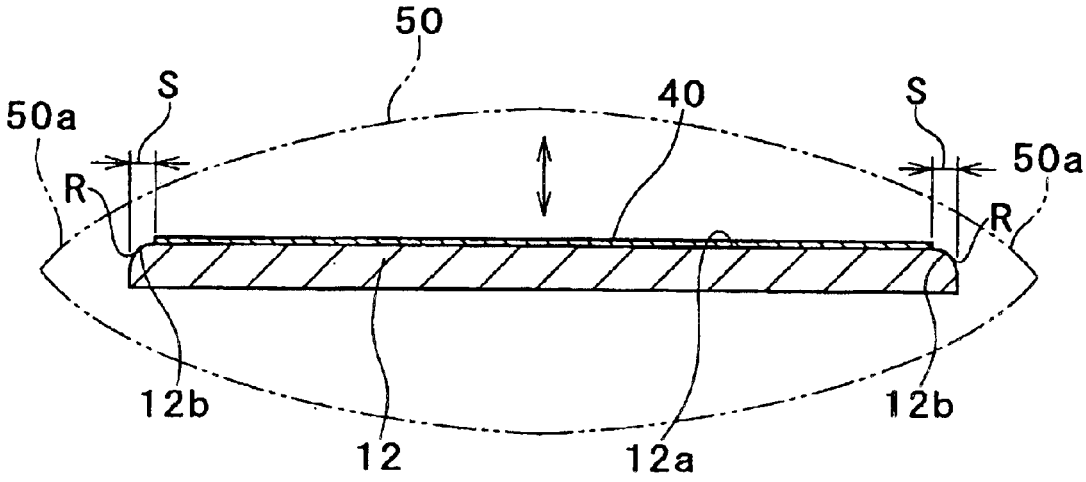
FIG. 3 is a cross-sectional view along A—A in FIG. 2.

FIG. 2 is a plan view showing the configuration of the platen, and FIG. 3 is a sectional view along A—A in FIG. 2. In FIG. 2 and FIG. 3, the fabric 50 illustrated by the dotted line is a T-shirt made of cotton fabric, and the surface of the chest portion or the back portion, which is to be printed on, is set on top of the platen 12. In other words, the fabric 50 forming a tubular or bag shape is placed over the platen 12, in such a manner that the platen 12 enters inside the opening of the fabric 50 (for instance, the hem opening of the T-shirt).

As shown in FIG. 2 and FIG. 3, the platen 12 forming a support section for installing the fabric 50 is generally made from metal and has an approximately rectangular shape, each edge being approximately 50 cm–60 cm long, for example. A cotton cloth 40 forming a sheet-shaped member is attached replaceably by means of double-sided adhesive tape, for example, on the upper face 12*a* of the platen 12. It is also possible to use a cotton cloth 40 having an adhesive tape attached to the rear face thereof, or an adhesive layer incorporated in the rear face thereof, or alternatively, the cotton cloth 40 may be installed on the upper face 12*a* of the platen 12 by means of a suitable fastening tool. Moreover, the cotton cloth 40 is substantially uniform in terms of the fibre of the material and the method in which it is woven, and the like.

Other than the cotton cloth 40, it is also possible to use as the sheet-shaped member, a woven material made from fibres having low pilling characteristics, such as silk, mixed silk fibre, wool, mixed wool fibre, artificial fibre, and the like, or alternatively, or a non-woven fabric, or the like. Moreover, it is also possible to use a leather material, such as chamois leather, or a sheet of rubber or flexible synthetic resin, or the like.

The cotton cloth 40 generates a static frictional force with respect to the fabric 50 installed on the surface thereof. If two thick stockinet fabrics of A4 size 623.7 $cm^2$ are placed mutually in tight contact, then they are able to support a force of approximately 30 g weight in the horizontal direction. Therefore, a value of 0.048 ($cm^2/g$) is obtained. Calculating on the basis of this value, although the coefficient of static friction between sheet materials varies with the type of cloth material laid thereon, a desirable range is 0.025 to 0.1.

As shown in FIG. 2 and FIG. 3, the cotton cloth 40 is formed such that it slightly smaller than the external shape of the platen 12. In other words, at each of the end portions 12*b* at the four side edges of the upper face 12*a* of the platen 12, a region of the platen 12 having a width of s is exposed. Desirably, the width s of these regions is 1 mm to 10 mm, and more desirably, it is approximately 5 mm. Furthermore, the upper side portion of each end section 12*b* of the platen 12 is formed with a curved face.

(Action of Holding Fabric on Platen)

Figure 4A:
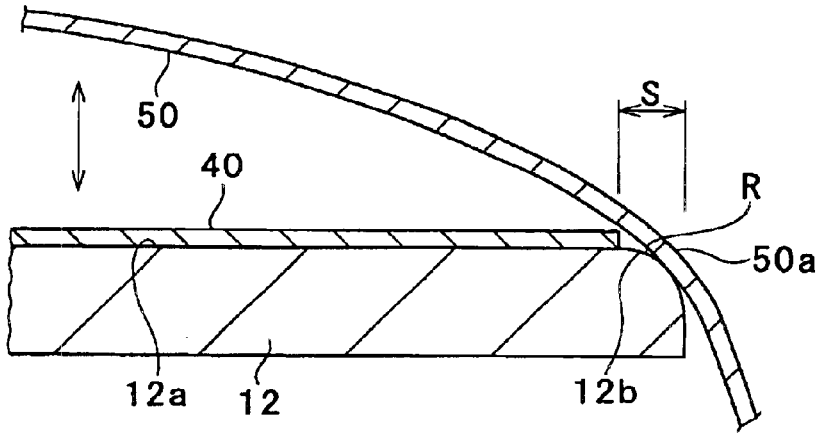
Figure 4B:
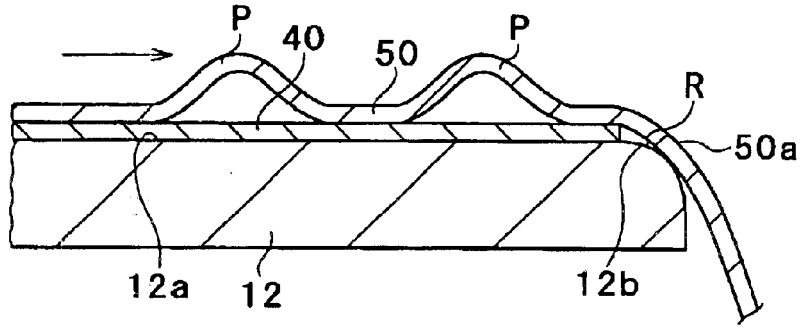
Figure 4C:
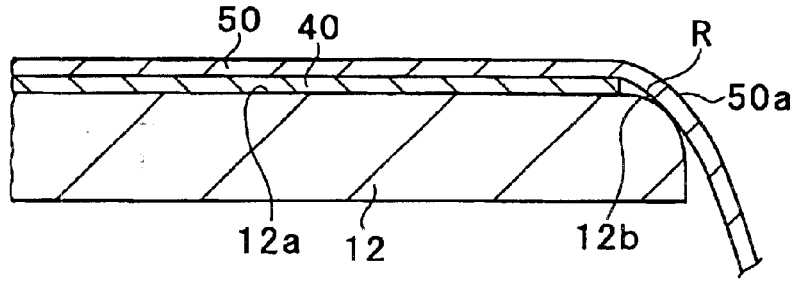
Figure 4D:
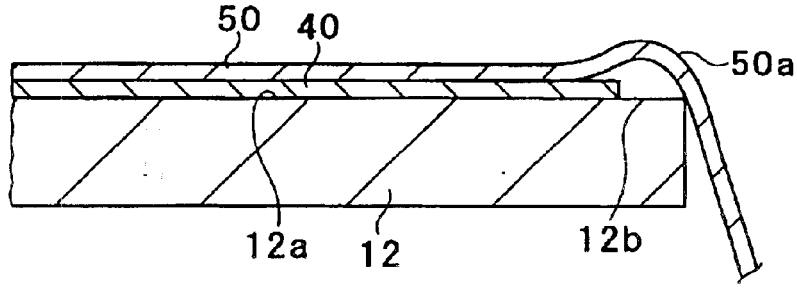
Figure 5A:
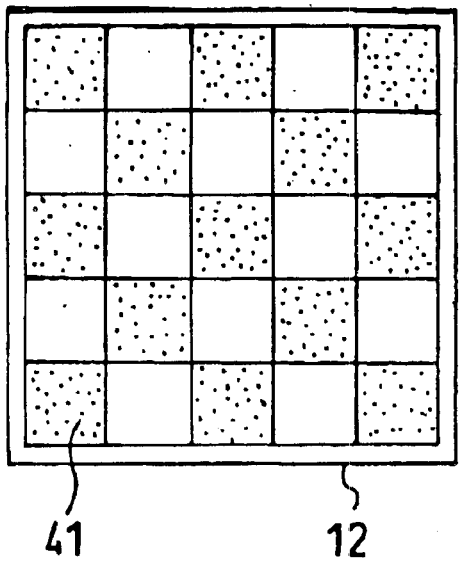
FIGS. 5A, 5B, 5C and 5D are plan views of the platen showing respective modification examples of the sheet-shaped member.
Figure 5B:
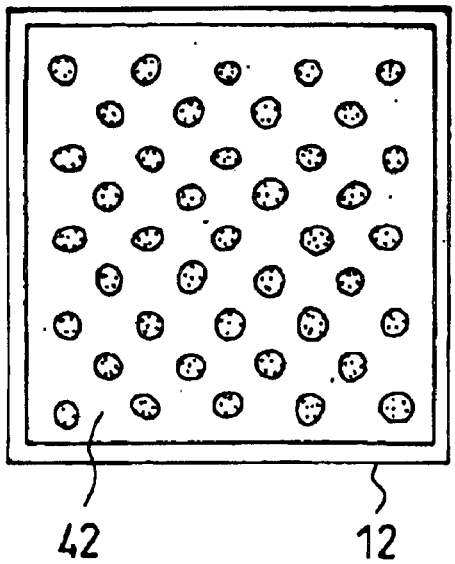
Figure 5C:
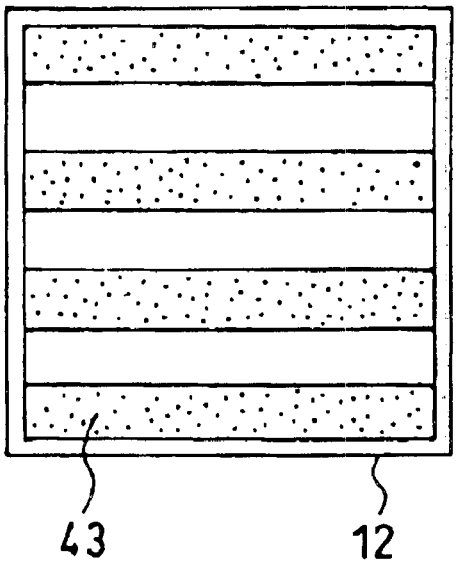
Figure 5D:
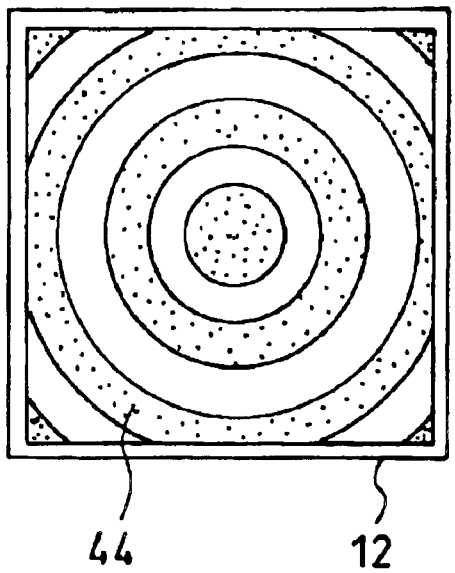

Next, the action of holding the fabric 50 on the platen 12 will be described. FIGS. 4A, 4B, 4C and 4D show enlarged cross-sectional views along B—B in FIG. 2, showing the principal part of the platen, FIG. 4A illustrating a state where the fabric has been installed, aligned in position and removed, FIG. 4B illustrating a state where wrinkles in the fabric are being eliminated, FIG. 4C illustrating a state where the fabric is held flat, and FIG. 4D illustrating a state where no curved face is formed on the end portions of the platen, to serve as a comparative example.

Firstly, as illustrated in FIG. 4A, the cotton cloth 40 is not present in the regions of the end sections 12*b* of the platen 12, and hence no substantial static frictional force acts in these end sections 12*b*. Therefore, even if the fabric 50 is larger than the platen 12, there is no substantial effect of the frictional force on the side portion 50*a* of the fabric 50 which contacts with the end section 12*b* of the platen 12 (the same applies to the other side portion thereof). Thereby, when installing the fabric 50 on the platen 12, aligning the position thereof, or removing it from same, it is possible to slide the side portions 50*a* of the fabric 50 smoothly, by lifting up the fabric 50 from the cotton cloth 40 on the platen 12, and causing only the side portions 50*a* of the fabric 50 to contact the regions of the end sections 12*b* of the platen 12. Thereby, the tasks of installing the fabric 50, aligning the position thereof and removing same are simple to perform, and hence the workability can be greatly enhanced.

Next, as illustrated in FIG. 4B, since a static frictional force acts on the fabric 50 by means of the cotton cloth 40, when the fabric 50 is lowered onto the platen 12 and installed thereon, then the fabric 50 is held by this frictional force. Here, even if wrinkles P occur in the fabric 50, since the fabric 50 is held simply by a frictional force, unlike a case which a fabric is held by an adhesive force, then simply by smoothing the surface of the fabric 50 lightly by hand in the direction of the arrow in FIG. 4B, it is possible to smooth out the wrinkles P and eliminate any creases in the fabric 50 in a simple and uniform manner, as illustrated in FIG. 4C. In this state, the flatness of the fabric 50 can be maintained reliably by the large frictional force.

Furthermore, since the fabric 50 is held simply by a frictional force, rather than an adhesive force, dust, and the like, is not liable to adhere to the cotton cloth 40, and hence frequent cleaning is not required. Even if dust, and the like, has collected, it can be cleaned away simply, just by blowing. Moreover, if the cotton cloth 40 becomes dirty, then it can be changed for a new one, and hence maintenance is also easy to carry out. Furthermore, by changing to a different sheet-shaped material in accordance with different types of fabric 50 which are installed in the device, it is possible to increase the general applicability of the device.

Since the end sections 12*b* of the platen 12 are formed with curved faces, then in the state in FIG. 4A described above, the side portions 50*a* of the fabric 50 are able to slide smoothly due to the presence of these curved faces. Moreover, if no such curved faces are formed on the end sections 12*b* of the platen 12, as illustrated in FIG. 4D, then when the fabric 50 is installed on the platen 12, there is a possibility that the side portions 50*a* of the fabric 50 may catch on the square edges of the end sections 12*b* of the platen 12, and the side portions 50*a* of the fabric 50 may be caused to rise up. In contrast to this, if curved faces are provided on the end sections 12*b* of the platen 12, as illustrated in FIG. 4C, then it will be possible to make the side portions 50*a* of the fabric 50 curve smoothly over these curved surfaces, and hence rising up of the side portions 50*a* of the fabric 50 can be prevented. Thereby, it is possible to prevent the occurrence of situations in which the surface of the ink-jet heads 5 makes contact with the fabric 50.

As described previously in relation to FIG. 1, since the platen 12 can be moved to an initial position to the front side of the ink-jet heads 5, then the tasks of installing the fabric 50 on the platen 12, aligning the position thereof, and then removing it from the platen 12, become easier to perform.

Next, FIGS. 5A, 5B, 5C and 5D are plan views of a platen showing modification examples of the sheet-shaped member. The embodiment described above related to an example in which a cotton cloth 40 exhibiting substantially uniform frictional force was applied to the platen 12 as a sheet-shaped member, but the frictional force does not have to be uniform in this manner. In other words, it is also possible to provide FIG. 5A cotton cloth 41 forming a chequerboard pattern, FIG. 5B cotton cloth 42 forming a dotted pattern, FIG. 5C cotton cloth 43 forming a striped pattern, or FIG. 5D cotton cloth 44 forming a circular ring pattern, as the sheet-shaped member installed on the platen 12. These patterns can be formed by changing the fibres or the weaving method, in a localized manner. A sheet-shaped member having local differences of this kind in the frictional force can be used. Moreover, a sheet-shaped member made from a material other than cotton cloth may also be used, it being possible, for example, to use a sheet-shaped member made from mixed silk fibre, wool, mixed wool fibre, artificial fibre, leather material (chamois or the like), resin, rubber material, or the like, and these sheet-shaped members may be selected in accordance with the material of the printing medium.

In the embodiment described above, the sheet-shaped member is stuck to the platen 12, but it is also possible to adopt a configuration wherein the surface of the platen 12 itself displays a static frictional force. For example, the surface of the platen 12 may be processed to have a rough surface, or the like. On the other hand, in addition to sticking or mounting the sheet-shaped member on the platen, it is also possible to install a plate-shaped or box-shaped member, detachably, by means of an interlocking system or embedding system. Furthermore, as described above, the frictional force may be substantially uniform or it may be localized. In the latter case also, it is possible to hold the fabric 50 by means of the frictional force. Any projections, or the like, formed on the surface of the platen 12 are undesirable from the viewpoint of smoothly eliminating any wrinkles that form.

A preferred embodiment of the present invention was described above, but the present invention is not limited to the aforementioned embodiment, and various design modifications are possible provided that they remain within the scope of the claims. For example, in the present embodiment, regions where no frictional force acts are provided in the respective end sections on the four side edges of the platen, but if the fabric to be installed on the platen is a tubular or bag-shaped fabric, such as a T-shirt, then the regions where no frictional force acts may be provided only in the respective end sections in the direction perpendicular to the direction in which the fabric is inserted. Furthermore, in addition to a tubular or bag-shaped fabric such as a T-shirt, the fabric installed on the platen may also be a single-sheet fabric of any size, such as a handkerchief, for example. Moreover, since no special mechanism is required for holding the fabric in place, this configuration may be used in combination with a further fabric fixing method, such as pressing the fabric by means of the frame, or gripping it between clips, or the like.

As described above, according to the present invention, when a fabric is installed on the supporting section, it is possible to hold the fabric by means of a large static frictional force acting on the fabric from the supporting face. Since the fabric is held simply by a frictional force, rather than being held by an adhesive force, then it is possible readily to eliminate any creases in the fabric, simply by smoothing the surface of the fabric lightly by hand and spreading out any wrinkles, and in this state, the fabric can be held reliably in a highly flat state by the frictional force. Thereby, it is possible greatly to enhance the workability in removing wrinkles from the fabric. Moreover, in so doing, there is no risk of causing pilling, or the like, of the fabric, unlike cases where the fabric is held by adhesive force.

Furthermore, since the supporting face holds the fabric simply by means of frictional force, rather than adhesive force, then dust, and the like, is not liable to adhere to the supporting face, and hence it does not need to be cleaned frequently. Moreover, even if dust, or the like, has collected thereon, it can be cleaned away readily, simply by blowing air on it. Consequently, maintainability is good and costs are low. Furthermore, if the static frictional force acts on the fabric from a sheet-shaped member on the supporting face, then if the sheet-shaped member becomes soiled, it can be changed for a new one, and hence maintainability is good. Moreover, by changing to a different sheet-shaped material in accordance with the type of fabric installed in the device, it is possible to increase the general applicability of the device. The sheet-shaped member is not a specialised member, and may be, for example, a cotton cloth, or the like, thus making it possible to achieve low costs.

Furthermore, since the static frictional force in at least the respective end sections of the supporting face is relatively reduced, then even if the fabric is larger than the supporting face, it is possible substantially to eliminate the effects of the frictional force at the respective side portions of the fabric contacting the respective end sections of the supporting face. Consequently, by raising the fabric above the supporting face and causing only the respective side portions thereof to contact the respective end sections of the supporting face, it is possible to slide the side portions of the fabric over the platen smoothly. Therefore, the tasks of installing the fabric, aligning the position thereof and removing same can be performed readily, and hence the simplicity of the required work tasks is greatly improved.

Furthermore, if curved surfaces are formed on at least the respective end sections of the supporting face, then it is possible to slide the respective side portions of the fabric over the platen even more smoothly. Moreover, when installing the fabric on the supporting face, the presence of the curved faces on the end sections prevents the respective side portions of the fabric from rising up, and it is therefore possible to prevent problems such as the heads of the ink emitting section coming into contact with the fabric.

The entire disclosure of the specification, claims, summary and drawings of Japanese Patent Application No. 2003-87545 filed on Mar. 27, 2003 is hereby incorporated by reference.

What is claimed is:

1. A fabric printing device comprising:

a supporting section on which a fabric can be installed and removed, having a supporting face for supporting an installed fabric from below; and an ink emitting section for emitting ink onto the fabric on said supporting face;

wherein said supporting section has a section in which the coefficient of static friction acting on the fabric in the central region of said supporting face is greater than the coefficient of static friction acting on the fabric in regions in the vicinity of the respective end sections of said supporting face in at least one direction thereof.

2. The fabric printing device according to claim 1, wherein in said supporting section, the coefficient of static friction acting on the fabric in the region of said supporting face other than the regions in the vicinity of said respective end sections is greater than the coefficient of static friction acting on the fabric in the region of said supporting face in the vicinity of said respective end sections.

3. The fabric printing device according to claim 2, wherein in said supporting section, the coefficient of static friction acting on the fabric in the region of said supporting face other than the regions in the vicinity of said respective end sections is substantially uniform throughout said region.

4. The fabric printing device according to claim 1, wherein in said supporting section a sheet-shaped member is adhered to or mounted on the region of said supporting face other than the regions in the vicinity of said respective end sections.

5. The fabric printing device according to claim 1, wherein the regions in the vicinity of said respective end sections are regions extending from each end section to a position 1 mm–10 mm distant therefrom.

6. The fabric printing device according to claim 1, wherein the upper portions of the respective end sections in at least one direction of said supporting face are formed with curved surfaces.

7. The fabric printing device according claim 1, wherein said ink emitting section and said supporting section can be moved relative to each other.

* * * * *